United States Patent [19]

Gasser

[11] Patent Number: 4,972,524

[45] Date of Patent: Nov. 27, 1990

[54] ANTI-PICKPOCKET DEVICE FOR POCKETS OF GARMENTS, FOR TROUSER POCKETS IN PARTICULAR

[76] Inventor: Karl Gasser, Verdignes Pradello, 50, 1-39043 Chiusa, Italy

[21] Appl. No.: 447,039

[22] Filed: Dec. 7, 1989

[30] Foreign Application Priority Data

Dec. 15, 1988 [IT] Italy ..... 4865/A88

[51] Int. Cl.[5] ..... A41D 27/20

[52] U.S. Cl. ..... 2/250; 2/248; 2/247; 150/133; 150/134

[58] Field of Search ..... 2/248, 250, 247, 253, 2/252, 251, 249, 254; 150/133, 134

[56] References Cited

U.S. PATENT DOCUMENTS

| | | | |
|---|---|---|---|
| 3,142,876 | 8/1964 | Roberts | 2/250 |
| 3,462,801 | 8/1969 | Bortle | 150/134 |
| 4,194,271 | 3/1980 | Hamilton | 150/134 |
| 4,241,476 | 12/1980 | Christenson et al. | 150/134 |
| 4,570,302 | 2/1986 | de Montalembert | 150/134 |
| 4,716,600 | 1/1988 | Van Beek | 2/250 |

FOREIGN PATENT DOCUMENTS

| | | | |
|---|---|---|---|
| 7806928 | 1/1980 | Netherlands | 150/134 |

*Primary Examiner*—William A. Cuchlinski, Jr.
*Assistant Examiner*—William C. Dowling
*Attorney, Agent, or Firm*—Shlesinger Fitzsimmons Schlesinger

[57] ABSTRACT

An anti-pickpocket device for pockets of garments, and for trouser pockets in particular, designed to make it extremely difficult to steal objects, for example wallets, from pockets after cutting the outer fabric of the pocket by means, for example, of a knife. According to the invention, the anti-pickpocket device is composed of a metal lattice from which extend at least two connecting elements designed to be secured to different points of the internal fabric of the pocket in such a way that the lattice extends over most of the internal surface of the outer fabric of the pocket, so that it is disposed between the object contained in the pocket and the outer fabric of the pocket.

3 Claims, 2 Drawing Sheets

FIG. 3
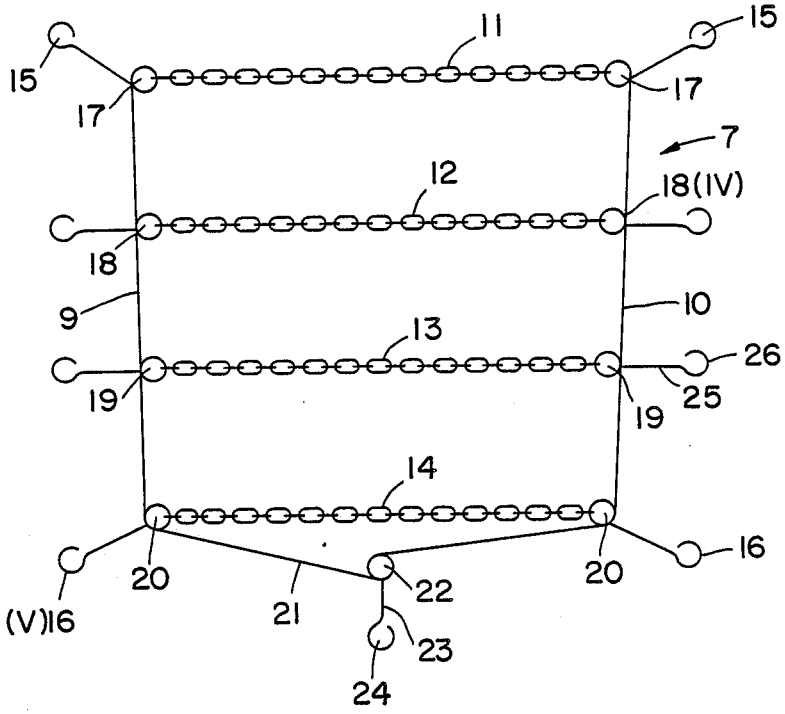
FIG. 4
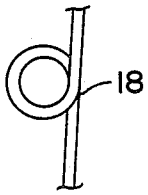
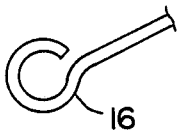
FIG. 5

ANTI-PICKPOCKET DEVICE FOR POCKETS OF GARMENTS, FOR TROUSER POCKETS IN PARTICULAR

This invention refers to an anti-pickpocket device for pockets of garments and for trouser pockets in particular. It is a well known fact that passengers, for example on underground railways, are very often faced with the problem of having their wallets stolen from their trouser pockets, by pickpockets who use sharp tools to cut the outer fabric of the pocket, thereby enabling them to easily grasp the wallet and make off with it.

The scope of this invention is to obviate this problem and to propose a solution whereby stealing objects from pockets by using knives is made practically impossible. This scope is achieved according to the invention by providing an anti-pickpocket device characterized by the fact of being composed of a metal lattice from which extend at least two connecting elements designed to be secured to different points of the internal fabric of the pocket in such a way that the lattice extends over most of the internal surface of the outer fabric of the pocket, so that it is disposed between the object contained in the pocket and the outer fabric of the pocket.

Further features of this invention will appear from the dependent claims.

The details and advantages of the anti-pickpocket device according to the invention will be described hereunder on the basis of one embodiment, represented in the accompanying drawing, in which:

FIG. 3 shows a schematic front view of the anti-pickpocket device according to the invention, and FIGS. 4 and 5 respectively show a detail of FIG. 3.

FIG. 1 shows the abdominal part of a pair of trousers, generically indicated by reference 1, provided with two pockets 3.

Figure 1:
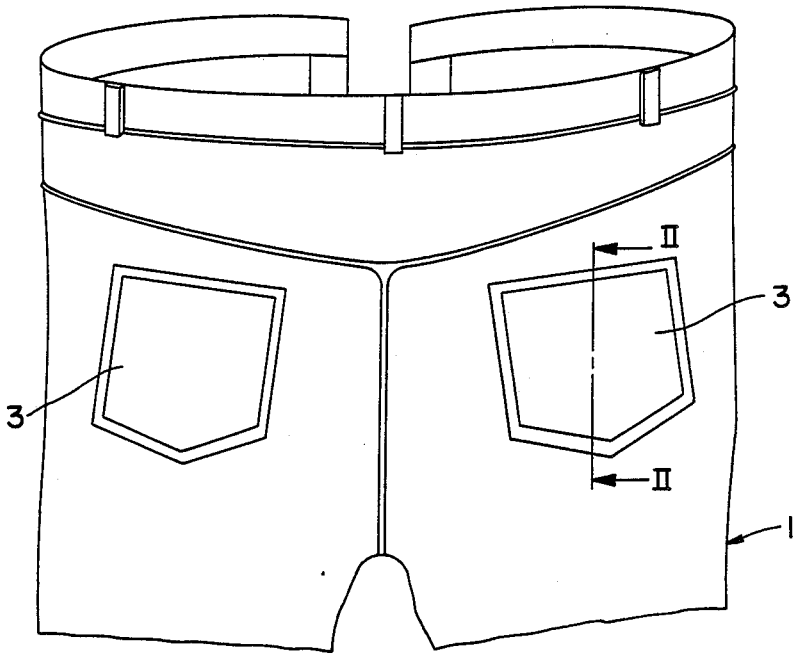
FIG. 1 shows a schematic perspective view of the abdominal part of a pair of trousers with two pockets.
Figure 2:
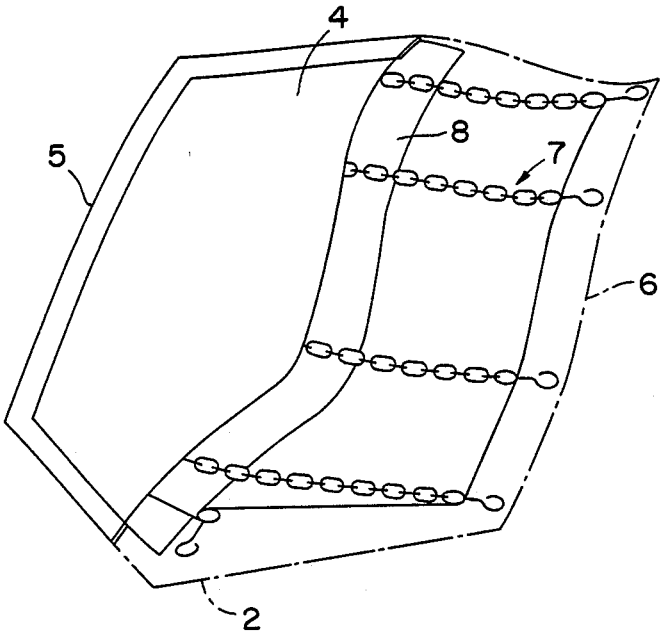
FIG. 2 shows an enlarged perspective partial cutaway view of a pocket, substantially along the line II—II of FIG. 1.

Each pocket 3 (FIG. 2) comprises a piece of cloth 4, sewn along the lateral edges 5 and 6 and along the lower edge 2 to the fabric of the trousers 1. The upper part of the piece of cloth 4 is free so as to form an aperture to enable, for example, a wallet to be inserted into the space between the cloth 4 and the trousers 1.

According to the invention, an anti-picket pocket device, generically indicated by reference 7, is disposed between the cloth 4 and the fabric of the trousers 1, preferably with the interposition of a piece of material 8.

As shown in FIG. 3, the anti-pickpocket device 7 is composed of two lateral metal wires 9 and 10, to be disposed in a substantially vertical direction, and of a plurality of chains, in this case four, 11, 12, 13 and 14 stretched horizontally between the two metal wires 9 and 10.

Each wire 9, 10 is provided on its free ends with a hook 15 and 16 bent laterally upwards to enable it to be secured by means of rivets, not shown, to seams 5, 6 and 2 in the pocket, which are often already provided in certain types of trousers such as, for example, blue jeans. Moreover, each metal wire is wound to form a plurality of eyelets, in this case four, 17, 18, 19, 20, designed to couple with the respective ends of the chains 11, 12, 13 and 14. The lower eyelets 20 are also designed to couple with a metal wire 21 whose central eyelet 22 serves to couple it with a stay wire 23 to be secured by 24 to the lowest point of the pocket 3.

The eyelets 18 and 19 on the contrary are designed to couple with respective stay wires 25 which, also in this case, can be secured for example by means of rivets 26 to the seams 5 and 6 of the pocket 3.

As can be seen, the anti-pickpocket device makes it practically impossible to cut the pocket, especially in a vertical direction, thus preventing objects contained in the pocket from being stolen. In order to protect the contents of the pocket from possible damage by the anti-pickpocket device the piece of material 8 is advantageously provided between the contents and the device.

I claim:

1. Anti-pickpocket device for the pockets of garments, in particular for trouser pockets, characterized by the fact of being composed of a metal lattice from which extend at least two connecting elements designed to be secured to different points of the internal fabric of the pocket in such a way that the lattice extends over most of the internal surface of the outer fabric of the pocket.

2. Anti-pickpocket device as claimed in claim 1, characterized by the fact that said lattice is composed of a plurality of chains, each of which is coupled at its free ends to eyelets in two metal wires disposed substantially parallel to each other, the ends of which are secured to the lateral seams of the pocket.

3. Anti-pickpocket device as claimed in claim 2, characterized by the fact that each eyelet is designed moreover to be coupled with stay wires, the free end of which is designed to be secured to said lateral seams.

* * * * *